United States Patent [19]

Kraiss

[11] 4,142,637

[45] Mar. 6, 1979

[54] BOAT TRAILER STORAGE RACK

[76] Inventor: Louis R. Kraiss, 34 Penn Ave., Souderton, Pa. 18964

[21] Appl. No.: 807,195

[22] Filed: Jun. 16, 1977

[51] Int. Cl.[2] ..... A47F 5/00

[52] U.S. Cl. ..... 211/182; 52/122; 211/191

[58] Field of Search ..... 52/122; 248/119 R, 165, 248/163; 108/106, 111; 211/182, 162, 186, 191, 189; 214/16.4 A, 16.1 A, 16.1 R, 16.1 D

[56] References Cited

U.S. PATENT DOCUMENTS

| | | | |
|---|---|---|---|
| 1,603,742 | 10/1926 | Broderick | 248/163 X |
| 2,358,698 | 9/1944 | Flath | 211/189 X |
| 2,428,856 | 10/1947 | Sinclair | 214/16.1 A |
| 2,944,667 | 7/1960 | Bell | 211/191 |
| 3,048,245 | 8/1962 | Shewell | 211/182 X |
| 3,494,478 | 2/1970 | Link | 211/182 X |
| 3,608,504 | 9/1971 | Peters | 108/111 X |

FOREIGN PATENT DOCUMENTS

| | | | |
|---|---|---|---|
| 528846 | 11/1921 | France | 108/106 |
| 76110 | 8/1961 | France | 214/16.1 R |
| 1432642 | 2/1966 | France | 108/106 |
| 627713 | 11/1961 | Italy | 214/16.1 R |
| 181279 | 10/1962 | Sweden | 211/191 |

*Primary Examiner*—Roy D. Frazier
*Assistant Examiner*—Robert W. Gibson, Jr.

[57] ABSTRACT

A boat trailer storage rack is of modular construction and is made with parts of short length which can easily be carried to an assembly place. It includes wheel tracks which can be moved to underlie wheels of different tread width and reduce manufacturing costs and assembly time.

1 Claim, 7 Drawing Figures

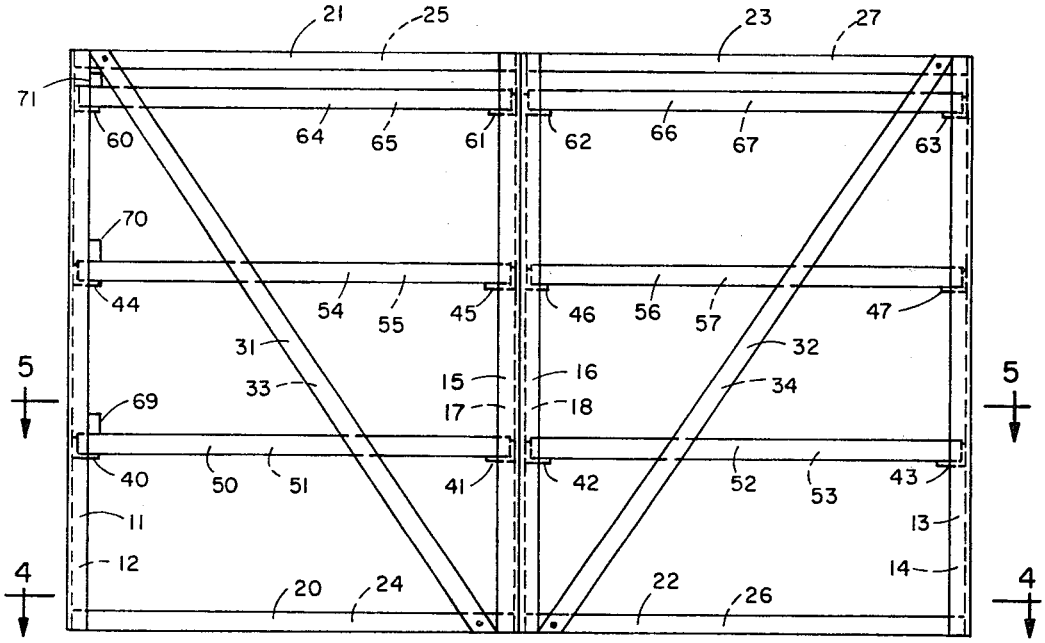
FIG. 1
FIG. 2
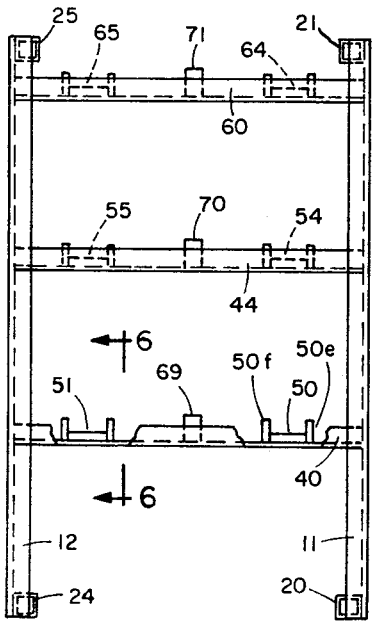
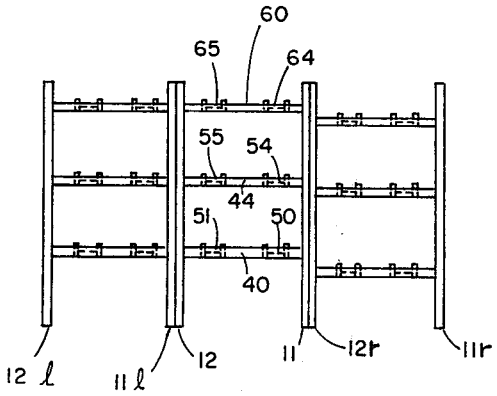
FIG. 7

FIG. 3
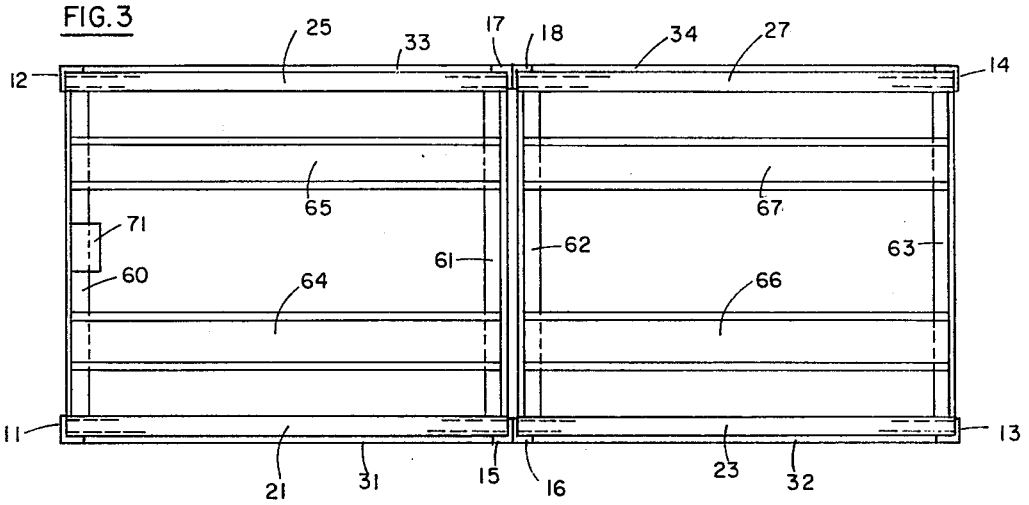
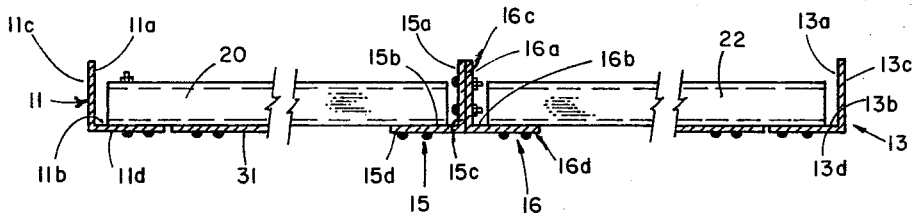
FIG. 4
FIG. 5
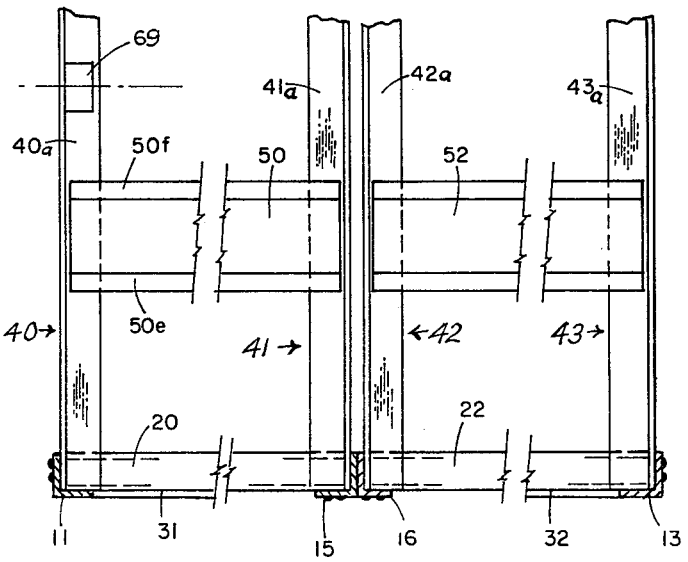
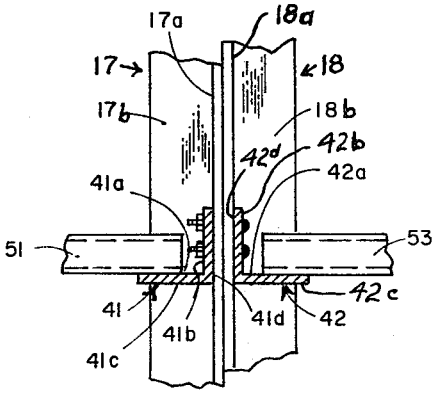
FIG. 6

BOAT TRAILER STORAGE RACK

PRIOR ART

U.S. Pat. No. 2,428,856 Sinclair 1947; U.S. Pat. No. 3,525,186 Lombardo 1970.

This invention relates to storage racks and particularly to a structural framework which is especially adapted to the parking or storage of boat trailers. The frame construction is multi-storied so that several boat trailers can be stored one above the other and also closely aside of each other.

The storage racks of the invention are intended to be used principally at marinas to eliminate the usual scattering of boat trailers around and along a shore area. Persons who transport their boats to the shore and unload the trailer in the water quite naturally wish to leave the trailer as close as possible to the place where the boat will be reloaded on the trailer. Usually, the boat is placed in and taken out of the water at an inclined ramp and the trailers will be strewn about the surrounding shore land.

The resulting disorganized parking of the boat trailers not only creates an unsightly appearance but also frequently makes it virtually impossible to get a particular trailer out from among the many other ones which have been parked close to it. After a person has parked his trailer, other persons frequently leave theirs so that he is crowded in and it is nearly impossible to extract his from the jumble.

The most important feature of the present invention is the provision of a storage rack which makes it possible to park several trailers in stacked arrangement in an orderly manner. By putting one above another a more efficient use is made of the ground area.

Storage racks have been made which might be used to hold boat trailers but they are unsatisfactory for this purpose principally because they are too complex and expensive. Some of them have had to be assembled at a factory and be transported as a finished unit in a truck to the place of use. Some of them can be assembled at the marina but they have required long structural steel parts which have required the use of a truck to carry them.

A feature of the present invention is that the rack is made wit parts which are small and short enough that they may be transported in a passenger automobile or station wagon. These parts can readily be assembled into the finished storage rack at the place where it is to be used. Moreover one or two persons can readily assemble the rack with the use of ordinary tools.

A problem which is created by the many different sizes and makes of boat trailers arises from the different tread width or distances between the wheels on the opposite sides of the trailers. The tread widths are so different that a conventional rack would require a wide, complete floor at each trailer location so that the wheels would be supported. A feature of the present invention is the provision of relatively narrow wheel support tracks or runways which are adjustable to positions to lie under the wheels. They are individually light in weight and can be moved at once to the positions to fit any track width.

Another feature of the structure is that it is modular or of a unitized formation so that they can be located aside of each other and be fastened together to form a multi-unit construction. Such a side-by-side assembly serves to provide additional strength and rigidity, and additional modules can be added at any future time.

A preferred embodiment of the invention is shown in the drawings, in which:

FIG. 1 is a side elevational view of a single module,

FIG. 2 is an elevational view of the left-hand end of FIG. 1,

FIG. 3 is a plan view of FIG. 1,

FIG. 4 is sectional view on the line 4—4 of FIG. 1 on an enlarged scale of the front side only, FIG. 5 is a sectional view on the line 5—5 of FIG. 1 on an enlarged scale of the front side only, FIG. 6 is a sectional view on the line 6—6 of FIG. 3 and FIG. 7 is an end view similar to FIG. 2 but showing another module unit attached to each of its sides, on a smaller scale.

There are four upright, outside corner posts 11, 12, 13 and 14. The posts 13 and 14 are farther away from the posts 11 and 12 than the posts 12 and 14 are away from the posts 11 and 13 so that in plan view as shown in FIG. 3 these four corner posts define an oblong rectangle. The posts 11 and 12 must be far enough apart to admit between them the entry of the widest boat which it is intended to store in the rack. The posts 11 and 13 must be far enough apart to accommodate the distance between the wheels and the front hitch of the trailer although some overhang is permitted.

To clarify the construction the faces of the corner posts have been identified as is best shown in FIG. 4. Each corner post is an angle iron and by that it is meant that it is a right angle in cross section. Preferably its two legs are of the same size but one may be somewhat longer than the other. The angle iron 11 has the two inside faces **11*a* and 11*b* and the two outside faces 11*c* and 11*d*; this identification of the faces is extended to the other angle irons as is clear from angle iron 13 in FIG. 4**. The inside faces of the corner posts, i.e., the faces a and b face inwardly of the rack.

Between the corner posts 11 and 13 and preferably midway thereof, is a pair of inside posts 15 and 16 which are angle irons. They are attached together by bolts or rivets or other fastening means in a back-to-back relationship. This means that their c faces are firmly against each other. Their inner faces a and b also face inwardly of the rack. Their outer faces d face outwardly and in fact the faces d of the posts 11, 15, 16 and 13 lie in the same vertical plane so that they in effect present a flat surface.

Between the opposite corner posts 12 and 14 is a similar pair of inside, angle iron posts 17 and 18. They are located directly across the rack from the inside posts 15 and 16 and they are fastened together and disposed with their inside faces facing inwardly in the manner just described. The outside d faces of the posts 12, 17, 18 and 14 lie in a common vertical plane.

The upright posts 11, 15, 16 and 13 are tied together by the horizontal, longitudinal bars. The tie bars 20 and 21 extend between and connect together the upright posts 11 and 15. The tie bars 22 and 23 extend between and connect together the upright posts 16 and 13. The tie bars 20 and 22 are fastened to the bottom ends of the posts and the tie bars 21 and 23 are fastened to the top ends of the posts.

The longitudinal tie bars 20, 21, 22 and 23 are only long enough to go between the inside posts 15–16 and the outside posts 11—13 and this is one of the features of the invention as they are relatively short and can be easily transported as explained above. This avoids the need for long longitudinal bars which would extend all the way from the post 11 to the post 13.

The upright posts 12, 17, 18 and 14 of the framework at the opposite side of the rack are tied together by corresponding horizontal, longitudinal bars 24, 25, 26 and 27. These several longitudinal tie bars may be angle iron but it is preferred that they be hollow, square tubing because of the additional strength and possibly lighter weight.

The several lomgitudinal tie bars are attached to the upright posts in a similar manner. As is shown in FIG. 4, the bar 20 is fastened to the b faces of the posts 11 and 15, and the bar 22 is fastened to the b faces of the posts 16 and 13. These attachments are preferably by bolts but rivets and even welding may be used. This inside location of the longitudinal tie bars leaves the outside d faces of the upright posts unobstructed.

The longitudinal tie bars 20 to 27 do not, of course, have to be at the extreme tops and bottoms of the upright posts 11 to 18 to be effective, The tie bars may be inwardly from the ends of the corner posts and this distance will largely depend on the strength of the posts themselves.

To minimize or prevent longitudinal sway of the rack it is advisable that the diagonal struts 31, 32, 33 and 34 be attached to the rack. They preferably are made of band iron having a thickness no greater than the thickness between the b and d faces of the upright posts so that the planar sides of the rack are preserved. As will be pointed out, this flat side is important so that the modular units may be laterally fastened together to form a multi side-by-side structure.

The strut 31 is fastened at its lower end to the tie bar 20 close to the post 15 and the top end is fastened to the tie bar 21 close to the post 11. This slant is considered preferable but the strut 31 could slope from the top of post 15 to the bottom of post 11. The other struts 32, 33 and 34 are attached to the rack in the manner just described for strut 31.

One side frame of the rack, therefore, is made up of the outside corner posts 11 and 13, the inside posts 15 and 16 which are attached as a pair, the longitudinal tie bars 20, 21, 22 and 23 and the struts 31 and 32. The opposite side frame is made up of the outside corner posts 12 and 14, the inside posts 17 and 18 which are attached as a pair, the longitudinal tie bars 24, 25, 26 and 27 and the struts 33 and 34. To laterally tie these two side frames together a plurality of transverse, cross bars are attached to them.

The transverse bar 40 connects posts 11 and 12, transverse bar 41 connects posts 15 and 17, transverse bar 42 connects posts 16 and 18 and the transverse bar 43 connects posts 13 and 14. All of these transverse bars are the same distance upwardly from the bottom ends of the posts so that they lie in the same horizontal plane.

These transverse bars are angle irons and their inner faces face inwardly of the rack; FIG. 6 shows that the faces 41*a* and 41*b* face inwardly of the rack. To accomplish this the face 41*d* is affixed to the face 17*a* of the inside post 17 as is shown in FIG. 6. A corresponding manner of attachment is applied to the other transverse bars 40, 42 and 43. This means that the a faces of these four transverse bars are disposed in the same horizontal plane.

The transverse bars 40 to 43 are at a height above the ground to permit a boat trailer to be moved or rolled under them and between the side frames. This height may selectively be different for separate racks. At a selected height above the transverse bars 40 to 43 there are fastened to the upright posts another set of transverse rails 44, 45, 46 and 47, so that these latter four are in a horizontal plane. The vertical distance between bar 40 and bar 44 must admit a boat trailer. The transverse bars are held in place by bolts, rivets or even welding.

To underlie the trailer wheels, wood planks are located to rest on the upwardly facing a faces of the transverse bars; FIG. 6. Two of the wood planks, or track rails, 50 and 51 rest at their outside ends on the a face of the transverse bar 40 and rest at their inner ends on the a face of the transverse bar 41. Two more of the wood planks, or track rails, 52 and 53 rest at their inside ends on the a face of the transverse bar 42 and rest at their outer ends on the a face of the transverse bar 43. The four planks 50 to 53 can freely be moved or slid to the proper position along the transverse bars 40 to 43 so that they underlie the wheels of the particular trailer to be rolled on them for storage. The planks 50 and 52 would be in line with each other and the planks 51 and 53 would be in line with each other if the length of the boat required this.

A corresponding set of wood planks or track rails 54, 55, 56 and 57 moveably rest on the upper set of transverse bars 44 to 47. They may, of course be placed at selected places entirely independent of the location of the lower set of wood planks. The vertical b faces of the transverse bars serve to prevent endwise movement of the planks off of them.

The advantage of using wood planks for the track rails is that they are relatively light in weight for their strength. Also they can be slid along the transverse bars with relative ease. It is possible to use metal beams made preferably of expanded metal instead of wood planks. To keep the wheels from running off of the sides of the planks it is advisable to affix upright guards to their opposite sides, such as the uprights 50*e* and 50*f*, as is best shown in FIGS. 2 and 5.

The planks 50 to 53 may be considered as forming a first tier or level above the ground and the planks 54 to 57 may be considered as forming a second tier or level. The drawings show that there may be a third tier or level which is constituted by the planks 64 to 67. It is realized that to put a trailer on this topmost level two persons or a mechanical lift may be required.

The top most track planks or rails 64 to 67 are supported by and moveable along the transverse bars 60 to 63 which are attached to the framework in the manner explained for the other transverse bars. The spacings between the levels does not need to be uniform and one of the levels may altogether be eliminated.

To provide a rest or support for the trailer hitch, blocks 69, 70 and 71 are attached respectively to the end transverse bars 40, 44 and 60 at mid points of their lengths. They may be merely a large block of wood which is bolted or otherwise fastened in place. The blocks provide relatively large bearing surfaces on their tops.

It has been stated above that the rack is a modular unit with flat sides so that they can be bolted together in a side-by-side arrangement as is shown in FIG. 7. The module in the middle will be recognized as the storage rack which has been illustrated in FIGS. 1 to 6 as the reference numerals are the same. The module at the right has the same basic construction and postscript r has been added to the corresponding parts; for instance, its vertical corner post 12*r* corresponds to the corner post 12 of the middle module. In like manner the module to the left has the same basic construction and the postscript 1 has been added to the corresponding part; i.e., corner post 121 corresponds to the post 12 of the middle module.

FIG. 7 shows that the tiers or levels of the separate modules may be at different heights. This adds to the versatility of the assembly as trailers of different heights may readily be accommodated.

The assembly of the parts to make a module is very simple. A preferred way is to bolt together, flat on the ground, each side frame; thus the posts 11, 15, 16, 13, the longitudinal bars 20, 21, 22, 23 and the struts 31 and 32 are bolted together on the ground. The other side frame with its posts 12, 17, 18, 14, longitudinal bars 24, 25, 26, 27 and struts 33 and 34 are bolted together on the ground. Then both side frames are moved to vertical positions and the transverse bars are attached at the preselected places. This properly spaces the side frames and forms a rigid module. Finally, the wheel planks are placed on the upwardly facing sides of the transverse bars.

To hold two or more modules side-by-side as in FIG. 7 it is merely necessary to pass bolts through the legs of the upright corner and inside posts which come together. For instance, bolts would be passed through the post 11 and post 12 and this would be carried out with the otherposts which lie together.

I claim:

1. A storage rack for boat trailers comprising four upright outside corner posts defining an elongated rectangle in plan outline, the posts being of angle iron having their inner faces facing toward the interior of the rack;

two upright pairs of inside angle iron posts with each pair disposed between the outside corner posts and along the longer side of said elongated rectangle, the angle irons of each pair being affixed in back-to-back relationship with their other backs facing outside of the rack;

top longitudinal tie bars affixed to the inner face, upper ends of the posts and extending from the inside posts to the outside posts;

bottom longitudinal tie bars affixed to the inner face, lower ends of the posts and extending from the inside posts to the outside posts;

transverse angle iron bars affixed to the other inside face of the outside and inside upright posts and extending across the rack, the inner faces of the transverse angle irons facing inwardly of the rack and disposing upwardly facing faces in a substantially common horizontal plane, track rails resting on said upwardly facing faces of the transverse bars and disposed longitudinally of the rack, the track rails being of narrow width and light in weight so they are readily movable to locations along the tranverse bars to positions to correspond to the wheel track width of trailers, all of said angle irons being right angles in cross section, and in which an outside transverse bar has an attached block to serve as a hitch rest.

* * * * *